US010801180B2

(12) United States Patent
Sherlock

(10) Patent No.: US 10,801,180 B2
(45) Date of Patent: Oct. 13, 2020

(54) WORK MACHINE SELF PROTECTION SYSTEM

(71) Applicant: Deere & Company, Moline, IL (US)

(72) Inventor: Lance R. Sherlock, Asbury, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 16/004,544

(22) Filed: Jun. 11, 2018

(65) Prior Publication Data

US 2019/0376260 A1 Dec. 12, 2019

(51) Int. Cl.

| | |
|---|---|
| ***G06F 19/00*** | (2018.01) |
| ***E02F 9/20*** | (2006.01) |
| ***E02F 9/24*** | (2006.01) |
| ***E02F 3/43*** | (2006.01) |
| ***E02F 3/32*** | (2006.01) |

(52) U.S. Cl.

CPC ..... *E02F 9/2033* (2013.01); *E02F 3/32* (2013.01); *E02F 3/435* (2013.01); *E02F 9/24* (2013.01)

(58) Field of Classification Search

CPC . E02F 9/2033; E02F 9/24; E02F 3/435; E02F 3/32; E02F 9/265; E02F 9/205; E02F 3/96; E02F 9/20; B25J 9/1666; B25J 9/1674; B25J 9/1676; G05B 2219/39094; G05B 2219/40479

See application file for complete search history.

(56) References Cited

U.S. PATENT DOCUMENTS 5,748,097 A * 5/1998 Collins ..... E02F 3/32 340/685
6,032,093 A * 2/2000 Denbraber ..... E02F 3/308 37/348
6,098,322 A * 8/2000 Tozawa ..... E02F 3/437 37/414
6,131,061 A * 10/2000 DenBraber ..... E02F 3/435 37/348
6,230,090 B1 * 5/2001 Takahashi ..... E02F 3/435 212/280

(Continued)

FOREIGN PATENT DOCUMENTS

DE 4110959 A1 10/1991
DE 4338056 A1 5/1994

(Continued)

OTHER PUBLICATIONS

German Search Report issued in Patent Application No. 10 2019 205 515.5 dated Dec. 12, 2019, 10 pages. (Translated).

*Primary Examiner* — Khoi H Tran
*Assistant Examiner* — Jorge O Peche
(74) *Attorney, Agent, or Firm* — Joseph R. Kelly; Kelly, Holt & Christenson, PLLC

(57) ABSTRACT

A work machine includes a controllable subsystem, the controllable subsystem having an actuator configured to actuate a movable element of the subsystem. The work machine also includes a control system configured to generate and send control signals to the controllable subsystem actuator, wherein the control signals cause an actuation of the actuator. The work machine also includes a self protection system configured to prevent the control system from sending a control signal to the actuator that would cause a collision between the controllable subsystem and a portion work machine.

17 Claims, 10 Drawing Sheets

(56) References Cited

U.S. PATENT DOCUMENTS 6,522,964 B1* 2/2003 Miki ..... E02F 9/205 172/315
9,580,886 B2* 2/2017 Nakagaki ..... E02F 9/2033
2003/0147727 A1* 8/2003 Fujishima ..... E02F 3/437 414/200
2008/0203949 A1* 8/2008 Shackelford ..... E02F 9/24 318/15
2008/0263912 A1 10/2008 Gharsalli et al.
2009/0030580 A1* 1/2009 Doi ..... E02F 9/2033 701/50
2010/0052684 A1* 3/2010 Fling ..... F16L 1/11 324/326
2012/0253512 A1* 10/2012 Sato ..... B25J 9/1661 700/245
2014/0110168 A1* 4/2014 Pursimo ..... E21B 7/022 175/24
2014/0200863 A1 7/2014 Kamat et al.
2016/0010312 A1* 1/2016 Kurihara ..... E02F 9/261 701/36
2016/0076228 A1* 3/2016 Nau ..... E02F 9/26 701/50
2016/0091002 A1* 3/2016 Miura ..... E02F 9/265 60/459
2016/0138240 A1* 5/2016 Ikegami ..... E02F 9/2225 701/50
2016/0251835 A1* 9/2016 Kitajima ..... E02F 3/32 701/50
2016/0273194 A1* 9/2016 Ikegami ..... E02F 9/2271
2016/0281331 A1* 9/2016 Ikegami ..... E02F 9/2033
2016/0289928 A1* 10/2016 Kitajima ..... E02F 3/3677
2016/0348340 A1* 12/2016 Kaneta ..... E02F 9/265
2017/0114519 A1* 4/2017 Hague ..... E02F 3/434
2017/0114526 A1* 4/2017 Yasuda ..... E02F 9/264
2017/0278425 A1* 9/2017 Kozumi ..... G09B 19/24
2017/0342680 A1* 11/2017 Iwamura ..... E02F 9/262
2017/0342687 A1* 11/2017 Iwamura ..... E02F 9/262
2018/0051446 A1* 2/2018 Yoshinada ..... B60R 1/00
2018/0179734 A1* 6/2018 Yamashita ..... E02F 9/24
2018/0313063 A1* 11/2018 Elkins ..... E02F 3/435
2019/0024348 A1 1/2019 Hiekata
2019/0211532 A1* 7/2019 Sakamoto ..... E02F 9/261

FOREIGN PATENT DOCUMENTS

DE 19507152 A1 9/1996
DE 69612271 T2 7/2001
DE 69831713 T2 5/2006
DE 112013000251 B3 8/2015
JP H07158123 A 6/1995
WO 2014119464 A1 8/2014

* cited by examiner

WORK MACHINE SELF PROTECTION SYSTEM

FIELD OF THE DESCRIPTION

The present description generally relates to the use of equipment in worksite operations. More specifically, the present description relates to controlling and protecting the equipment from self harm.

BACKGROUND

There is a wide variety of different types of equipment, such as forestry equipment, construction equipment, and agricultural equipment. These types of equipment are often operated by an operator and have sensors that generate information during an operation.

Many types of equipment are modular machines that can be equipped to use a variety of different attachments. For example, excavators and loaders have many options for attachments. Some of these include buckets, grapples, augers, trench diggers, etc.

The discussion above is merely provided for general background information and is not intended to be used as an aid in determining the scope of the claimed subject matter.

SUMMARY

A work machine includes a controllable subsystem, the controllable subsystem having an actuator configured to actuate a movable element of the subsystem. The work machine also includes a control system configured to generate and send control signals to the controllable subsystem actuator, wherein the control signals cause an actuation of the actuator. The work machine also includes a self protection system configured to prevent the control system from sending a control signal to the actuator that would cause a collision between the controllable subsystem and a portion of the work machine.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Many types of machinery are becoming more modular, meaning that they are able to perform a variety of different functions by replacing a controllable attachment. For example, excavators traditionally have a bucket as an attachment. However, today there are many different kinds of buckets and many different attachments that can replace the bucket, such as a grapple, an auger, a compaction wheel, a backfill blade, a concrete crusher, a slope packer, a trench digger, etc. While this modularity increases the functionality of a work machine, it can provide some challenges when switching between attachments of different sizes. For instance, an excavator may be designed with one bucket in mind, such that any motion of the excavator attachment will not inflict self-harm (e.g., the attachment will not make contact with another part of the excavator and damage it). However, when an attachment of a different size is used on the excavator, movement of the attachment to a certain position can inflict self-harm, (e.g., the attachment can contact and harm, a portion of the excavator that is to be protected from contact). Some excavators can even inflict self-harm with a stock attachment that they were designed to work with. Accordingly, the present description describes a system that utilizes the geometry of a work machine and its attachments and automatically controls the machine to prevent self-harm.

Figure 1:
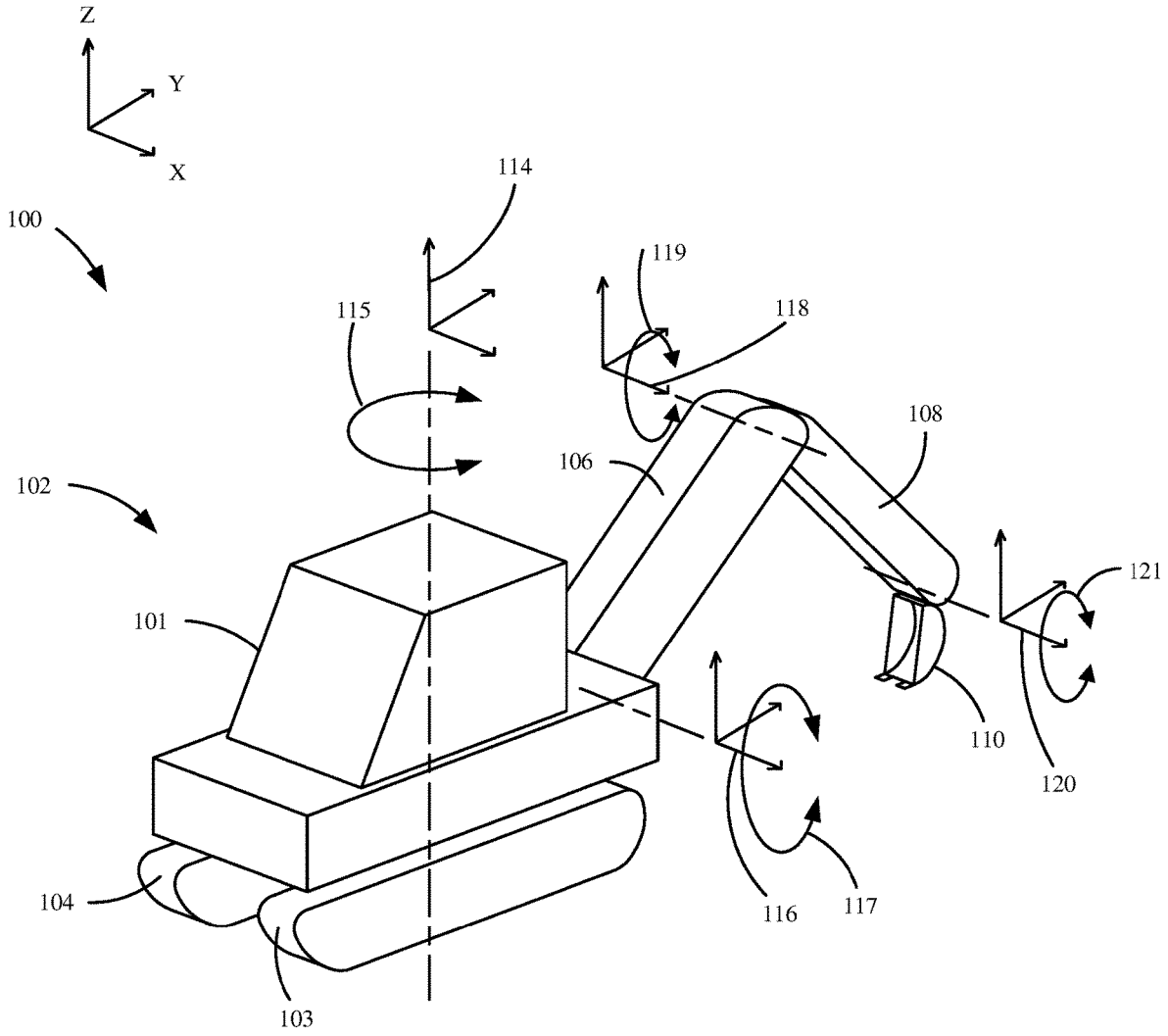
FIG. 1 is a perspective view of one example of a work machine.

FIG. 1 is a perspective view of one example of a work machine 102. While this disclosure is described primarily in the context of work machine 102 being an excavator, it is expressly contemplated that work machine 102 could be a wide variety of different machines including a loader, skid steer, etc.

Work machine 102 is operated by an operator located in cab 101. Work machine 102 can include a variety of different controllable subsystems 148 that each comprise a movable element 150 (shown in FIG. 2) and an actuator 152 (also shown in FIG. 2) to actuate the movable element. In the example shown in FIG. 1, the movable elements of controllable subsystems 148 include tracks 103, house 104, boom 106, stick 108 and attachment 110. They are each driven by one or more corresponding actuators (such as hydraulic cylinders, or other actuators). Tracks 103 are mounted to a frame of machine 102 and are driven by an engine to guide and propel work machine 102 about a work site 100. In other examples, tracks 103 can be replaced by wheels or other ground engaging elements. Cab 101 is coupled to the house 104 where internal components of work machine 102 are housed. Some of these internal components include an engine, transmission, hydraulic pumps, etc. House 104 is rotatably coupled to the frame of machine 102. House 104 rotates about house axis 114 in the direction indicated by arrows 115. Boom 106 is also rotatably coupled to the frame or house 104. Boom 106 rotates about boom axis 116 in the direction indicated by arrow 117. Stick 108 is rotatably coupled to boom 106. Stick 108 rotates about stick axis 118 in the direction indicated by arrow 119. Attachment 110 is rotatably coupled to stick 108. Attachment 110 rotates about attachment axis 120, in the direction indicated by arrow 121. As shown in FIG. 1, attachment 110 is a bucket, however, attachment 110 may be a wide variety of different attachments. For example, attachment 110 can be a grapple, an auger, a jackhammer, a trench digger, etc.

In an example operation, an operator in cab 101 can raise boom 106 by rotating boom 106 counter clockwise about axis 116. At the same time, the operator can rotate stick 108 clockwise about axis 118 and attachment 110 clockwise about axis 120. Moving these components in the way described may bring attachment 110 into contact with, and potentially damage, house 104 or tracks 103. A system described in greater detail below can limit movement of the movable elements to inhibit one part of machine 102 from contacting a protected portion of mobile machine 102 (e.g., it inhibits this self harm).

Figure 2:
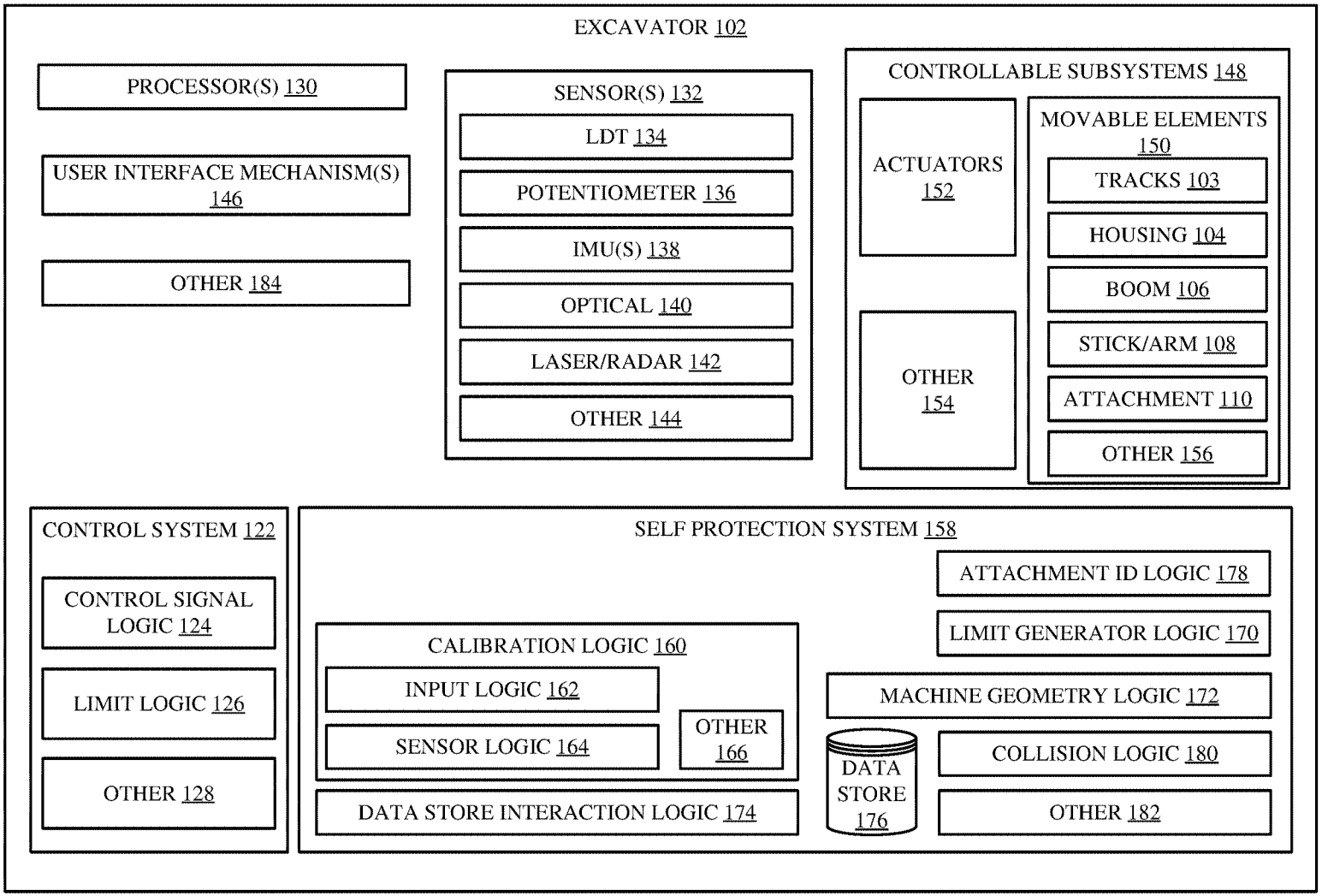
FIG. 2 is a block diagram showing one example of an operating environment.

FIG. 2 is a block diagram showing one example of portions of machine 102 in more detail. Machine 102 includes a variety of components including control system 122, processor(s) 130, sensors 132, user interface mechanisms 146, controllable subsystems 148, self protection system 158 and can include other items as well, as indicated by block 184. Controllable subsystems 148 include movable elements 150 which, as described above, include tracks 103, house 104, boom 106, stick 108, attachment 110 and it can include other items 156 as well. Each movable element also has a corresponding actuator 152. Movement of these controllable subsystems 148, by actuating actuators 152, has been described in greater detail with respect to FIG. 1 above.

Control system 122 is used to control controllable subsystems 148. Control system 122 includes control signal logic 124, limit logic 126 and it can include other items 128. Control signal logic 124 generates control signals that are sent to actuators 152 of controllable subsystems 148. When actuators 152 receive a control signal they perform a given function, such as to extend, retract, rotate, etc. In some instances, however, limit logic 126 (as will be described in greater detail below) generates a limit signal that inhibits control system 122 from sending a control signal when an actuator 152 is determined to be at risk of actuating a component so that it comes into contact with a portion of machine 102.

The operator can control, and interact with, excavator 102 through user interface mechanisms 146. User interface mechanisms 146 can include a variety of different mechanisms including displays, touch screens, levers, pedals, steering wheel, joysticks, etc. Actuation of user interface mechanisms 146 can activate control signal logic 124 to generate a control signal. For instance, moving a lever or joystick may cause control signal logic 124 to send a control signal to lift boom 106 by actuating a corresponding actuator 152 to move a hydraulic rod in the actuator 152.

Excavator 102 can include a variety of different sensors 132, including linear displacement transducers (LDTs) 134, potentiometers 136, inertial measurement units (IMUs) 138, cameras 140, laser/radar based sensors 142 and can include other sensors as well, as indicated by block 144. LDTs 134 can sense the linear displacement, such as hydraulic rod extension of hydraulic actuators, which are used on machine 102. Some examples of LDTs 134 include magnetostrictive transducers, Hall effect sensors, etc. When a hydraulic actuator is coupled to a moveable element 150, such as bucket 110, boom 106 or stick/arm 108, etc., the position of the moveable element relative to other parts of machine 102 is a function of the extension of the hydraulic rod. So, the sensor output can be used to identify a relative position of the moveable element.

Potentiometers 136 can sense an angle of rotation of moveable element 150 on work machine 102. For example, a potentiometer 136 coupled to a joint or linkage between house 104 and boom 106 can sense what angle boom 106 is at relative to house 104. Using trigonometry on the angle values from the potentiometer in combination with the physical dimensions of the elements, a position of the movable elements relative to other portions of machine 102 can be calculated.

IMU's 138 can sense an angle of rotation and an acceleration or force. For example, an IMU placed on the end of attachment 110 can be used to sense the movement and position of attachment 110. Camera 140 can be used to track or identify the position of various movable elements 150. Laser or radar-based sensors 142 can be used to track or identify the position of various controllable subsystems 148, as well.

It will be noted that, while machine 102 is shown with self protection system 158, self protection system 158 can be located remotely from machine 102 as well. Self protection system 158 illustratively includes calibration logic 160, limit generator logic 170, machine geometry logic 172, datastore interaction logic 174, datastore 176, attachment identifier (ID) logic 178 and can include other items as well, as indicated by block 182. These logic components are described in greater detail below with respect to FIGS. 4 and 5.

Briefly, calibration logic 160 receives or determines physical dimensions/measurements of controllable subsystems 148, for example, attachment 110. Limit generator logic 170 generates soft limits and corresponding limit signals and sends them to limit logic 126. Limit logic 126 implements the limits when control system 122 is controlling controllable subsystems 148. For instance, a limit can be set on an actuator 152 to prevent the corresponding movable element 150 from contacting another portion of machine 102. Machine geometry logic 172 receives sensor signals from sensors 132 and determines the positions of the movable elements 150 that are driven by actuators 152 in controllable subsystems 148. If so, limit generation logic 170 determines where the limit of movement is so as to avoid the collision and generates the limit signal. For example, trigonometry, kinematics, geometry, and one or more sensor signals and component measurements can be used to determine the position of a movable element 150. Collision logic 180 receives positions and movements of moveable elements 150 and determines if a collision hazard between the movable elements 150 and other portions of machine 102 is present. For example, this can be done using computational collision or intersection detection methods (described in more detail below). Datastore interaction logic 174 retrieves and stores information in datastore 176. This information can include component dimensions, ranges of motion, attachment identifiers, etc. Attachment ID logic 178 receives an indication of an attachment ID and uses data store interaction logic 174 to retrieve and load saved attachment dimensions.

Figure 3:
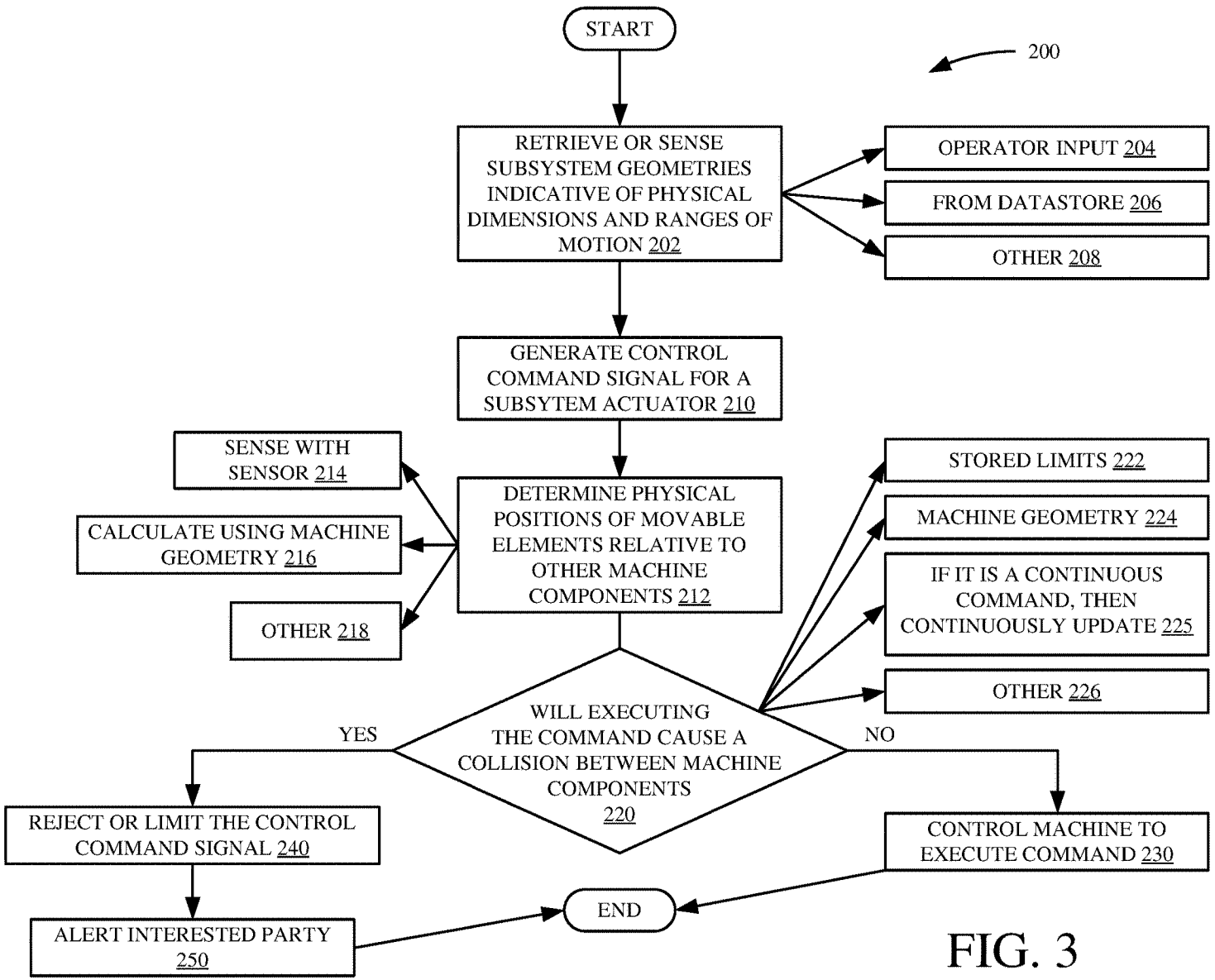
FIG. 3 is a side view of one example of a sensor configuration on a work machine.

FIG. 3 is a flow diagram showing one example of the operation of excavator 102 in controlling its subsystems to avoid moving movable elements 150 so they contact another portion of excavator 102. Operation 200 begins at block 202 where calibration logic 160 receives geometry information indicative of physical dimensions and ranges of motion of various parts of work machine 102, such as movable elements 150 and actuators 152 in controllable subsystems 148. The geometries may be received as input from an operator, as indicated by block 204. For instance, the operator can measure one or more of the movable elements 150 in controllable subsystems 148 and input these measurements through input logic 162. This is described in further detail below with respect to FIG. 4. The geometries can also be retrieved by datastore interaction logic 174 from datastore 176, as indicated by block 206. For instance, the values may have been previously entered by an operator or were preloaded by the machine manufacturer or were retrieved from a remote source. Geometries can be retrieved in other ways as well, as indicated by block 208.

Operation 200 proceeds to block 210 where control signal logic 124 generates a control command signal to control an actuator 152 of a controllable subsystem 148 to perform a commanded movement. However, before the signal is sent to actuator 152, self protection system 158 completes a self protection check, an example of which is represented by blocks 212-226.

At block 212, machine position logic 172 determines the positions of controllable subsystems 148. The positions may be sensed with sensors 132, as indicated by block 214. For example, optical sensor 140 can visually detect the positions of movable elements 150. Other sensors can sense the positions of actuators 152. The positions can be calculated using the known machine geometry of each connected subsystem, as indicated by block 216. For example, a position calculated, or sensed, for boom 106 can be used to calculate the position of stick 108 because they have a known geometric relationship relative to one another (e.g., movement of the boom also moves the stick). Further, sensing the position of stick 108 relative to boom 106, and using the known geometry of boom 106 and stick 108, the position of the end of stick 108, that is connected to attachment 110, can also be determined. Then, sensing the position of attachment 110 relative to stick 108, and using the known geometry of attachment 110, the location of the perimeter of attachment 110 relative to other portions of machine 102 can also be identified. The positions may also be determined in other ways as well, as indicated by block 218.

At block 220, once the positions of controllable subsystems 148 are known, collision logic 180 can determine if executing the commanded movement indicated by the command generated in block 202, to move a movable element relative to other components of machine 102, will cause a collision. A collision is indicated by the intersection between perimeters of two components. For instance, if the perimeter of bucket 110 will intersect with the perimeter of boom 106, then this means that bucket 110 will collide with the broom 106. To make this determination, collision logic 180 may determine that the commanded action will cause a movable element 150 to pass a stored limit that was previously identified as a limit generated by limit generator logic 170 to avoid a collision. This is indicated by block 222. For example, where stick 108 and attachment 110 are in a known fixed relationship, a limit may be set to only rotate attachment 110 a certain amount before it will hit stick 108 regardless of the position of stick 108 or any other component. Collision logic 180 can use the machine geometry to identify the perimeter of each of the movable elements 150, and can use the sensor signal to identify location of the perimeters, relative to the perimeter of other portions of machine 102 and determine whether carrying out the commanded movement will result in any intersections between the different parts of machine 102, as indicated by block 224. For example, using the dimensional data from machine geometry, a three-dimensional perimeter of each movable element 150 and other parts of machine 102 are calculated or known. In some cases, the perimeters can be virtually defined by a bounding box drawn around each of the movable elements 150 or by other virtual perimeter objects. Collision logic 180 can simulate the requested movement and then check to determine whether there is an intersection between any of the component perimeters, bounding boxes or other virtual perimeter objects.

It should also be noted that the commanded movement may be continuous. For instance, the operator may be holding a joystick in a position that continuously commands movement of a movable element 150. In that case, collision logic 180 continues to make the collision determination. This is indicated by block 225. In another example, a collision can also be determined in other ways as well, as indicated by block 226.

If it is determined at block 220 that there will not be a collision, then operation 200 proceeds to block 230. where control system 122 sends the control command signal to an actuator 152 of a controllable subsystem 148 and the command is executed. When the command is executed, actuator 152 will move its respective movable element 150, as commanded.

If collision logic 180 determines that there will be a collision, then operation 200 proceeds to block 240 where collision logic 180 sends an indication of collision to limit generator logic 170 which generates a limit signal indicative of a limit of movement to avoid the collision. It sends the signal to control system 122 and the control command signal is rejected and not sent or limit logic 126 imposes a limit on it, based on the limit signal from limit generator logic 170, so the commanded movement is only executed (e.g., it is limited) so as to avoid the collision. This causes the actuator 152 to control movement of movable element 150 so it stops short of the protected component it was going to collide with. At block 250, an alert or notification can be sent to an interested party that the control signal was rejected or limited. For example, a display in the cab can indicate to the operator that the command was rejected or limited to prevent a collision. Alternatively, the operator need not be notified and rejection of the command simply acts as a limit on the movement of the movable element 150, much the same as a mechanical limit acts.

Figure 4:
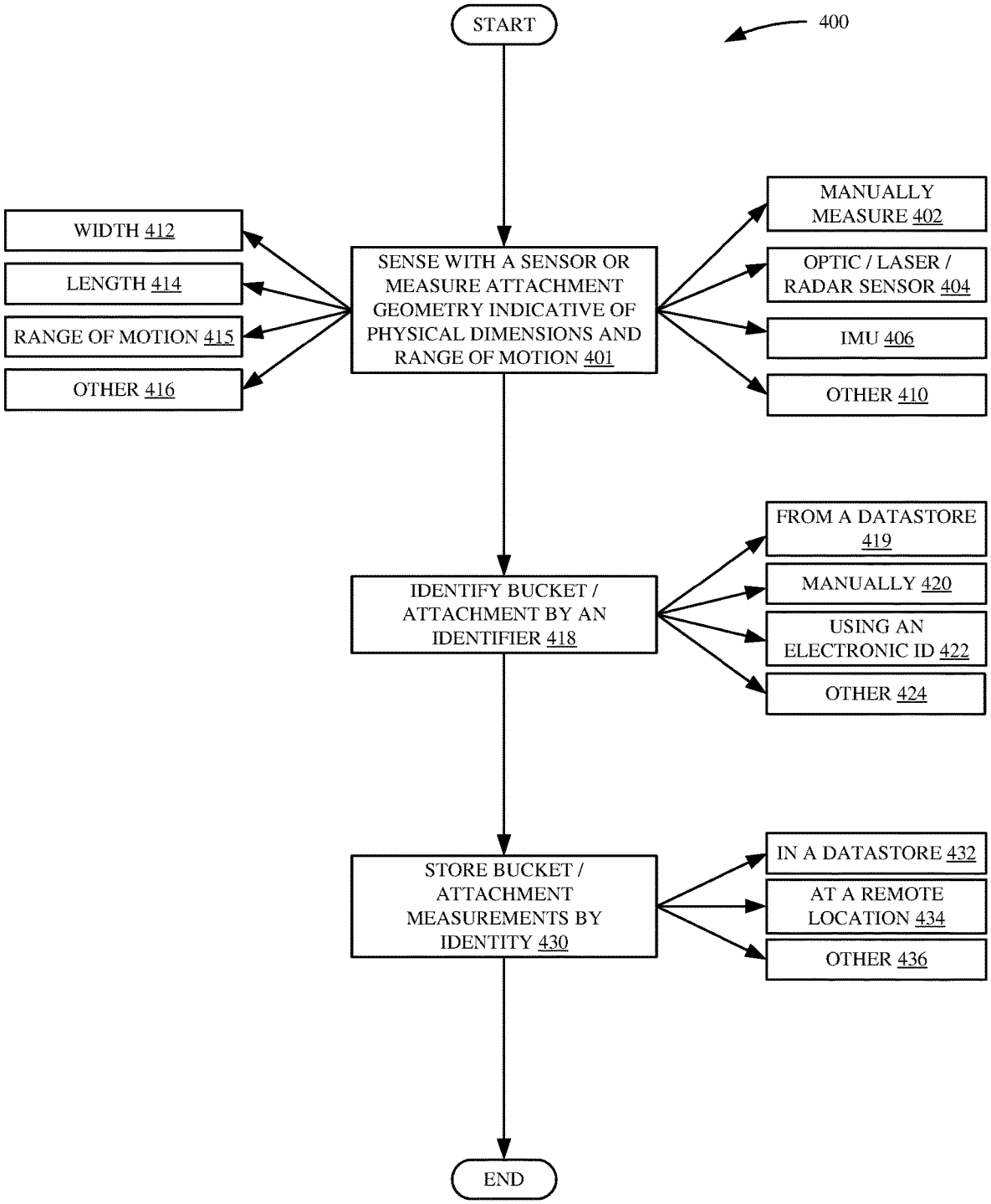
FIG. 4 is a flow diagram showing one example of the operation of the machine in performing calibration.

FIG. 4 is a flow diagram showing one example of the operation of calibration logic 160 in calibrating the self protection system. At block 400, a geometry of the attachment 110, indicative of its physical dimensions and range of motion, is sensed with a sensor or measured. The geometry can be manually measured by a person and entered into self-protection system 158 through input logic 162, as indicated by block 402. For example, the operator can measure from a distal end tip of attachment 110 (e.g., the farthest extending tooth on a bucket) to a linkage point of the attachment 110 (e.g., where the bucket attaches to stick 108) to get a length of attachment 110. To get a width of attachment 100 an operator can measure from one side of the attachment to the opposing side (e.g., from an exterior side wall of a buck to the other exterior side wall). To get a depth of attachment 100 an operator can measure from a top of the attachment to the bottom of the attachment (e.g., the top of a side of the bucket to the bottom of the deepest portion of the bucket). These measured values are then using user interface mechanisms 146 to input logic 162. Logic 162 can, for instance, provide a user interface with data entry fields and prompt the user for the measurements. It can also instruct the user how to take the measurements.

The dimensions of attachment 110 can be sensed with an optical sensor, a laser-based, radar-based or similar sensor and its geometry can be determined by sensor logic 164, as indicated by block 404. The dimensions of attachment 110 can be sensed by an IMU sensor as attachment 110 is moving and its geometry can be calculated by sensor logic 164 using kinematics, as indicated by block 406. Dimensions of attachment 110 may be sensed or received in other ways as well, as indicated by block 410.

Geometry of attachment 110 can refer to the width of attachment 110 as indicated by block 412, the length of attachment 110 as indicated by block 414, a range of motion as indicated by block 415, and it can refer to other dimensions of attachment 110 as well, as indicated by block 416. The range of motion can be identified by moving attachment 110 between its extreme ranges of motion and providing an input indicating when it is at each extreme. The range of motion can be sensed or identified in other ways as well.

At block 418, the measured attachment 110 is given an identifier. This identifier can be used in storing/retrieving the geometry information for this particular attachment 110 in datastore 176, as indicated by block 419. This identifier can then be manually placed on the attachment, as indicated by block 420. For example, an operator may paint or otherwise mark an identifier on the attachment. An identifier can be given via an electronic identification tag, as indicated by block 422. For example, a unique identifying RFID tag can be attached to attachment 110 that is read by an RFID reader on work machine 102. The reader can then send an indication to attachment ID logic 178 to load the saved geometry of that attachment when it is attached to machine 102. Of course the attachment 110 can be identified in other ways as well, as indicated by block 424.

At block 420, the dimensions of the attachment 110 and its identifier are stored for later use by self protection system 158. This data can be stored at a local datastore 176 on the work machine, as indicated by block 432. This data can be stored at a remote system, as indicated by block 434. This data can be stored in other ways as well, as indicated by block 436.

Figure 5:
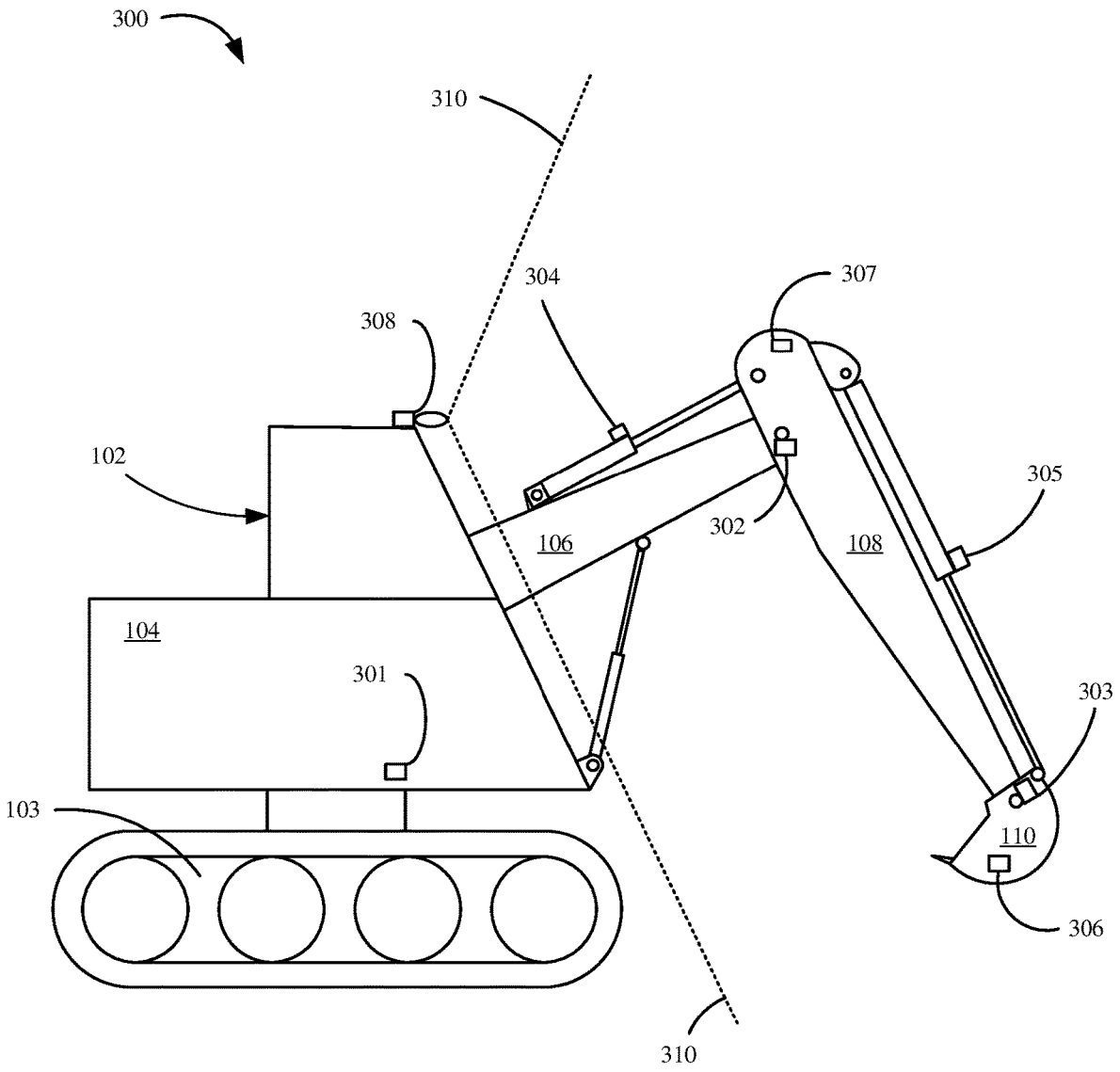
FIG. 5 is a flow diagram showing one example of the operation of the machine in performing self protection.

FIG. 5 is a side view of one example of a sensor configuration 300 on work machine 102. FIG. 5 also shows some of the items in FIG. 1 mounted to frame 99 of machine 102. Sensor configuration 300 is only one example configuration, and it is expressly contemplated that there are other sensor configurations. Further, it may be that only a subset of the sensors shown in FIG. 5 are used. For example, as is described below, it may be that only sensor 308 is used. In another example, sensors 301-308 are examples of sensors 132. Sensors 301-303 are potentiometers coupled to linkages between two components. For example, sensor 301 is coupled to the linkage between house 104 and tracks 103 and generates a signal indicative of a position between those components, relative to one another. Similarly, sensor 302 is coupled the linkage between boom 106 and stick 108 and sensor 303 is coupled to the linkage between stick 108 and attachment 110. Sensor 302 generates a signal indicative of the relative positions of boom 106 and stick 108, and sensor 303 generates a signal indicative of the extent of extension of the actuator that moves bucket 110 relative to stick 108, and thus the position of attachment 110 relative to stick 108.

Sensors 304-305 are LDT's coupled to the hydraulic actuators that drive different moveable elements. For example, sensor 304 is coupled to the hydraulic actuator that actuates stick 108 and generates a signal indicative of the extent of extension of the hydraulic actuator and thus the position of stick 108. Similarly, sensor 305 is coupled to the hydraulic actuator that controls attachment 110 and generates a signal indicative of the extent of extension of the actuator.

Sensors 306-307 are IMU sensors coupled to movable elements 108 and 110, respectively. Because an IMU tracks inertia, acceleration and rotation, then using kinematics, for example, the position or movement of the movable element can be mathematically calculated if the IMU is placed at a known position on the movable element.

Sensor 308 can be a camera, laser-based, radar-based or similar type of sensor along with its image processing logic or other sensor signal detection and processing logic. These types of sensors have a line of sight, an example of which is indicated by line of sight 310. Sensor 308 can generate a signal indicative of a position of a component within its line of sight 310. For example, a camera can visually sense that attachment 110 is a certain distance away from house 104. Instead of calculating the position of attachment 110 relative to house 104, sensor 308 can generate a signal indicating when attachment 110 crosses a threshold distance from house 104. The signal can be used to stop the actuators from moving bucket 110 any closer so as to avoid a collision. Similar sensors 308 can be placed at other locations on machine 102 as well, to protect against collisions between other parts of machine 102

The present discussion has mentioned processors and servers. In one example, the processors and servers include computer processors with associated memory and timing circuitry, not separately shown. They are functional parts of the systems or devices to which they belong and are activated by and facilitate the functionality of the other components or items in those systems.

Also, a number of user interface displays have been discussed. They can take a wide variety of different forms and can have a wide variety of different user actuatable input mechanisms disposed thereon. For instance, the user actuatable input mechanisms can be text boxes, check boxes, icons, links, drop-down menus, search boxes, etc. They can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which they are displayed is a touch sensitive screen, they can be actuated using touch gestures. Also, where the device that displays them has speech recognition components, they can be actuated using speech commands.

A number of data stores have also been discussed. It will be noted they can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

Figure 6:
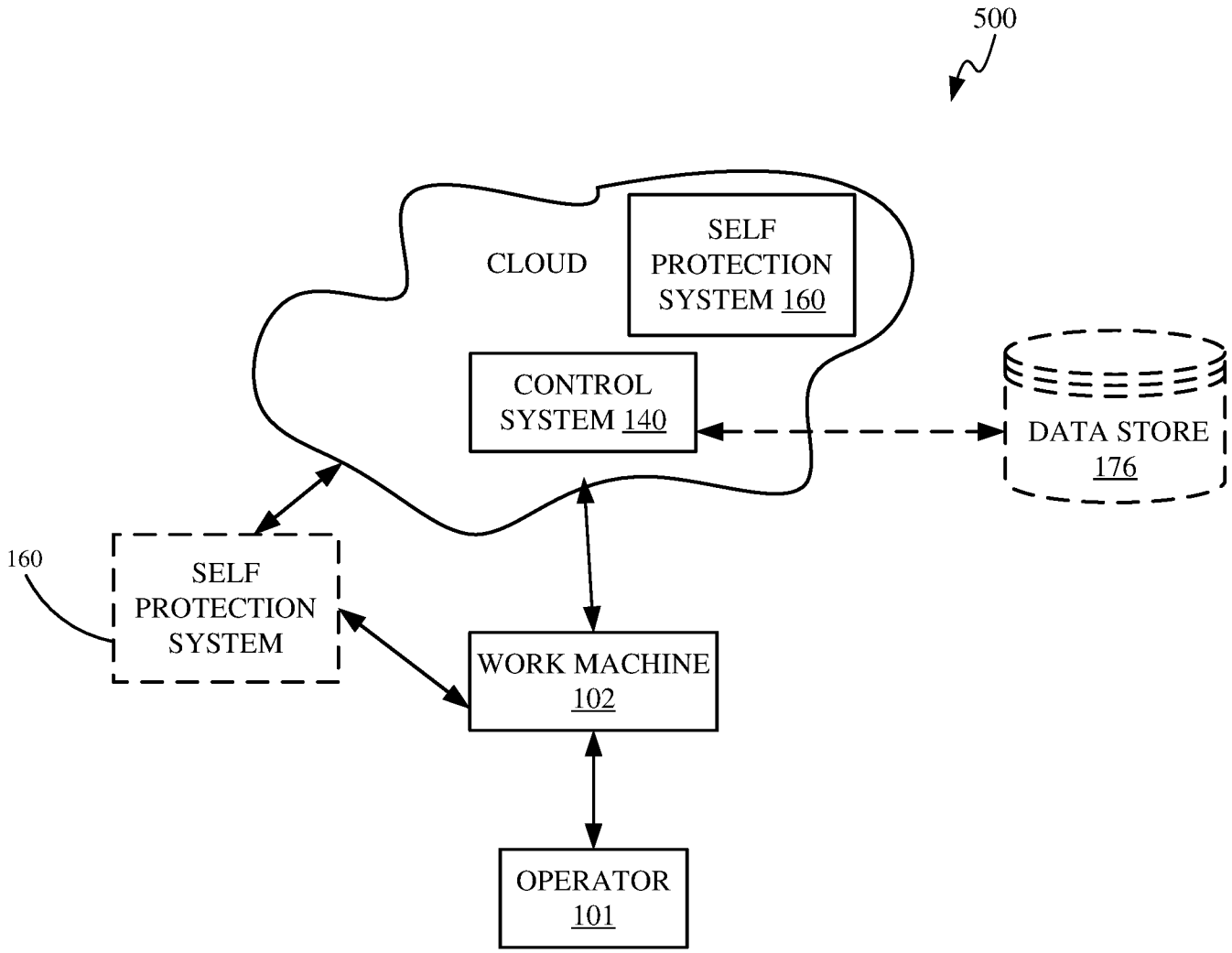
FIG. 6 shows one example of the work machine, as part of a remote server architecture.

FIG. 6 is a block diagram of self protection system 158, shown in FIG. 2, except that it communicates with elements in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network and they can be accessed through a web browser or any other computing component. Software or components shown in FIG. 2 as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, they can be provided from a conventional server, or they can be installed on client devices directly, or in other ways.

In the examples shown in FIG. 6, some items are similar to those shown in FIG. 2 and they are similarly numbered. FIG. 6 specifically shows that instead of being located on machine 102, self protection system 158, control system 122 and/or data store 176 can be located at a remote server location 502. Therefore, work machine 102 accesses those systems through remote server location 502.

FIG. 6 also depicts another example of a remote server architecture. FIG. 6 shows that it is also contemplated that some elements of FIG. 2 are disposed at remote server location 502 while others are not. By way of example, self protection system 158 can be disposed at a location separate from location 502, and accessed through the remote server at location 502. Regardless of where they are located, they can be accessed directly by work machine 102, through a network (either a wide area network or a local area network), they can be hosted at a remote site by a service, or they can be provided as a service, or accessed by a connection service that resides in a remote location. Also, the data can be stored in substantially any location and intermittently accessed by, or forwarded to, interested parties. For instance, physical carriers can be used instead of, or in addition to, electromagnetic wave carriers. In such an example, where cell coverage is poor or nonexistent, another work machine (such as a fuel truck) can have an automated information collection system. As the work machine comes close to the fuel truck for fueling, the system automatically collects the information from the work machine using any type of ad-hoc wireless connection. The collected information can then be forwarded to the main network as the fuel truck reaches a location where there is cellular coverage (or other wireless coverage). For instance, the fuel truck may enter a covered location when traveling to fuel other machines or when at a main fuel storage location. All of these architectures are contemplated herein. Further, the information can be stored on the work machine until the work machine enters a covered location. The work machine, itself, can then send the information to the main network.

It will also be noted that the elements of FIG. 2, or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 7:
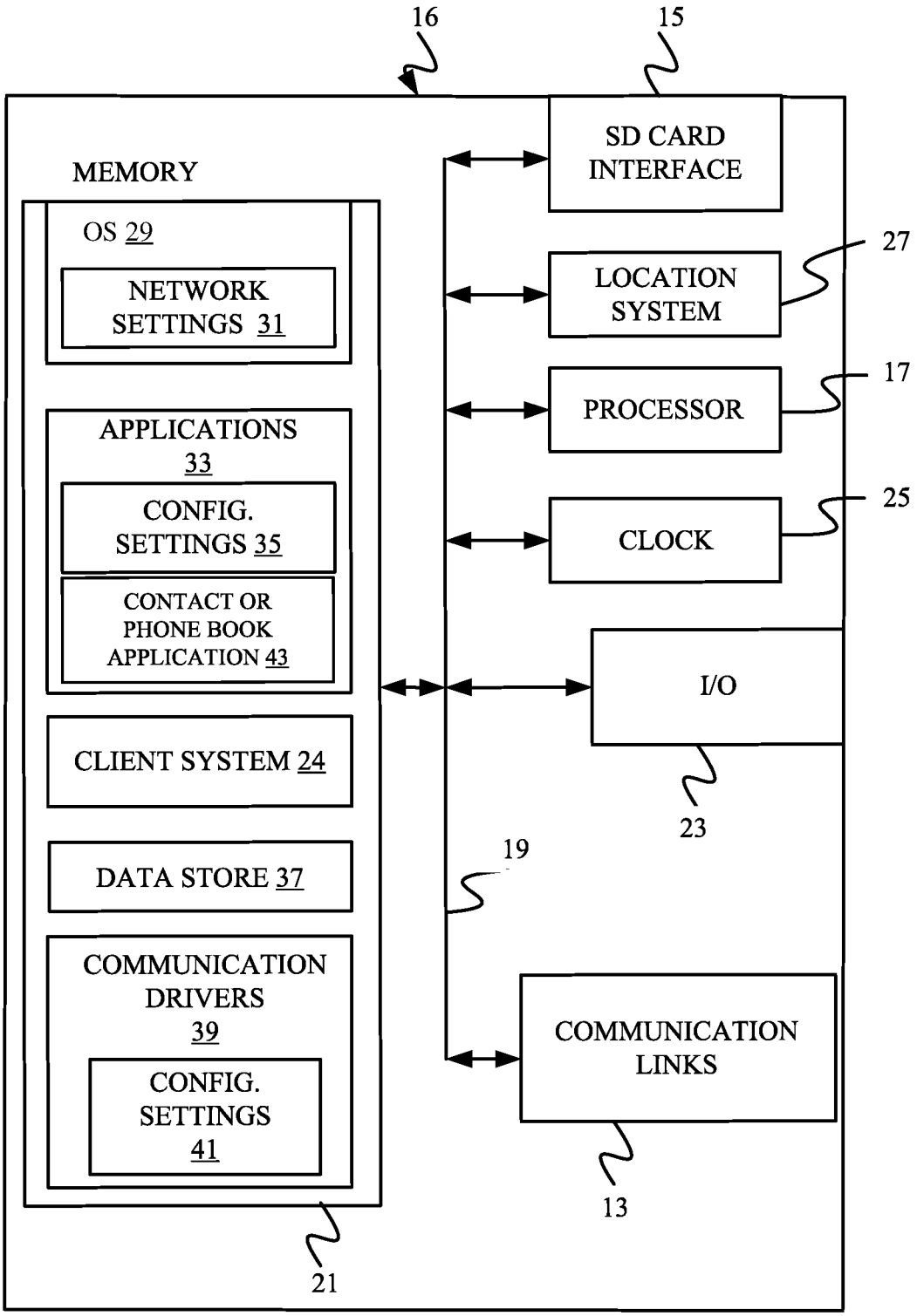
FIGS. 7-9 show examples of mobile devices that can be used with the work machine and the remote server architectures shown in the previous figures.
Figure 8:
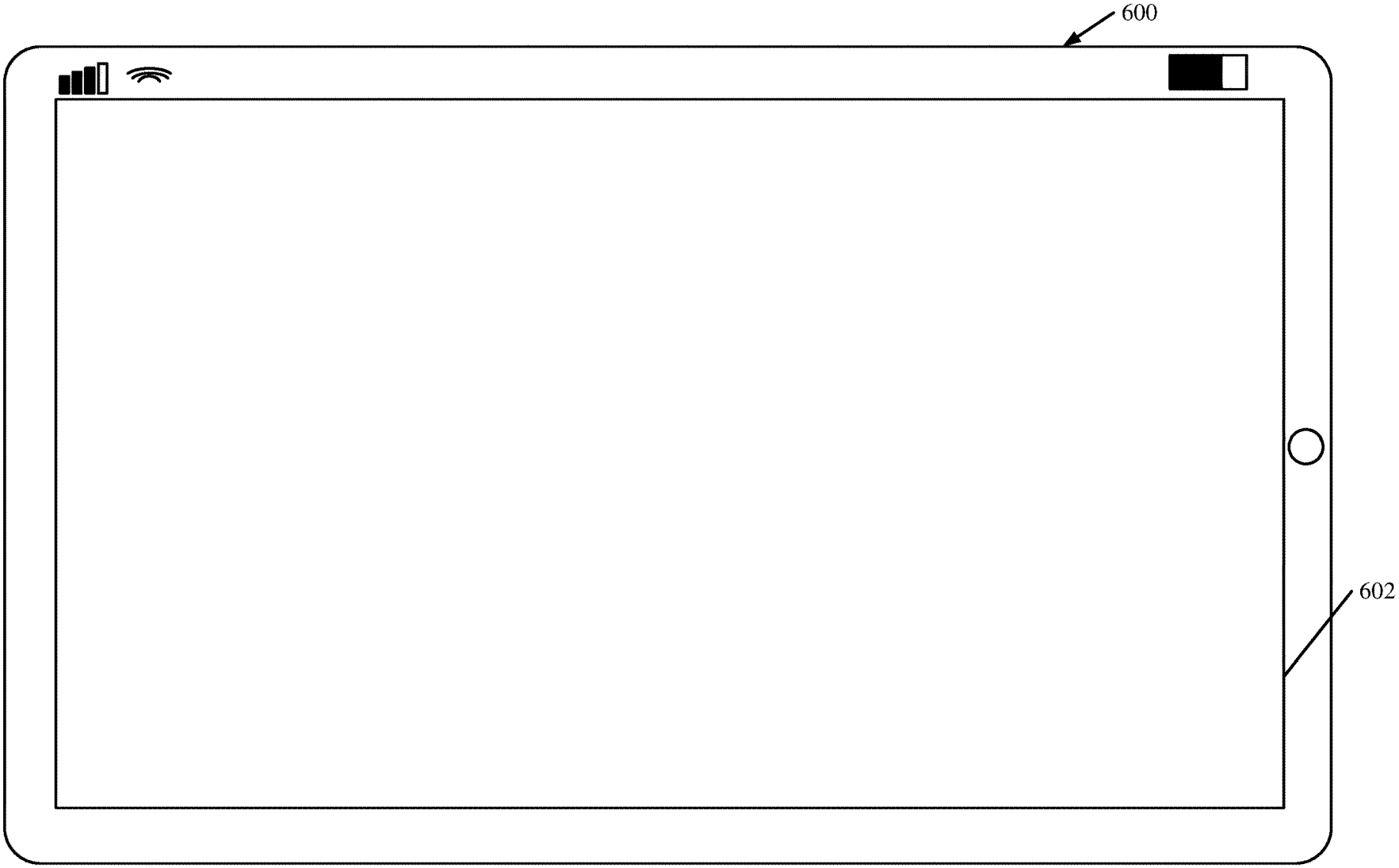
Figure 9:
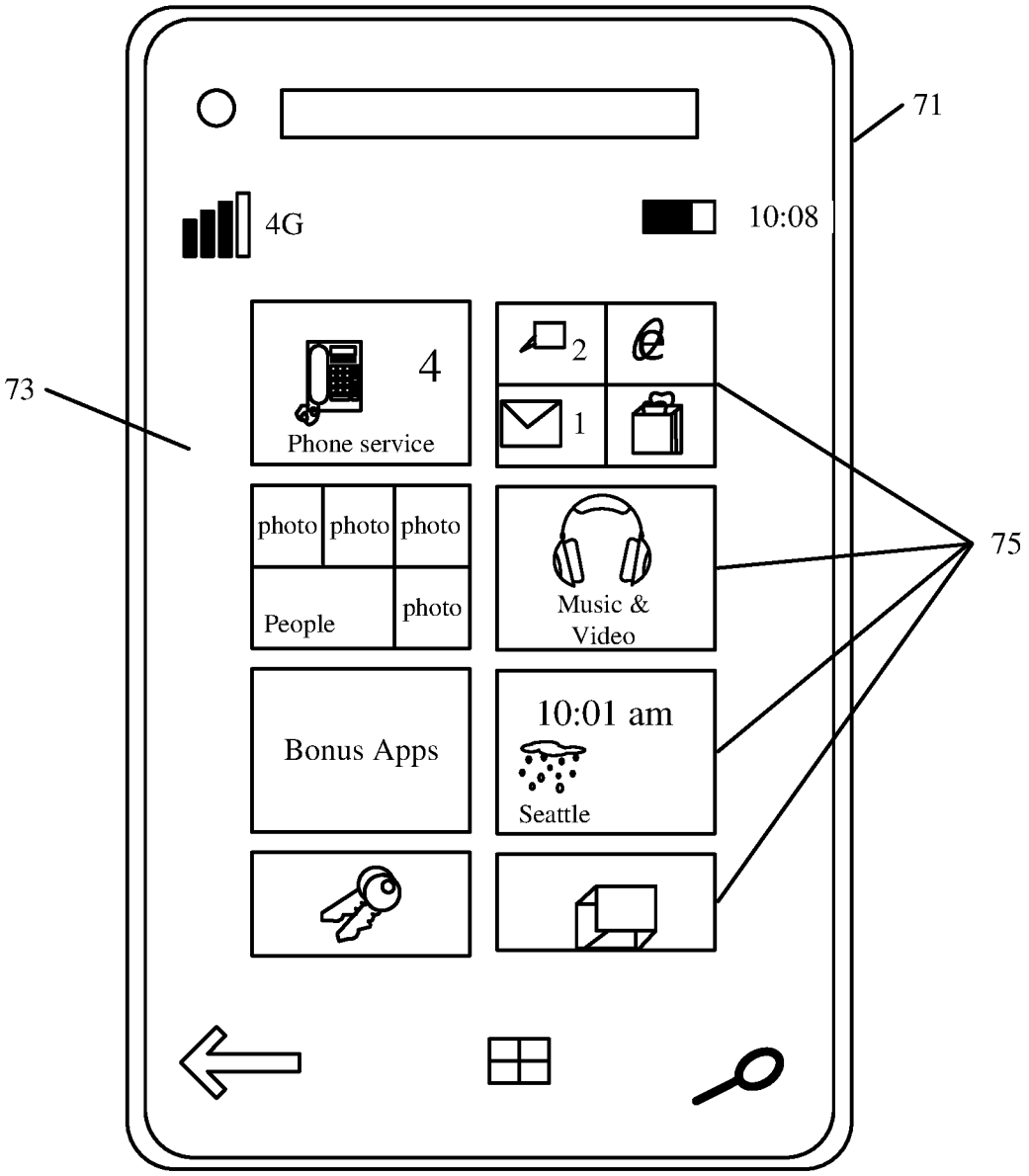

FIG. 7 is a simplified block diagram of one illustrative example of a handheld or mobile computing device that can be used as a user's or client's handheld device 16, in which the present system (or parts of it) can be deployed. For instance, a mobile device can be deployed in the operator compartment of work machine 102 for use in generating, processing, or displaying the stool width and position data. FIGS. 8-9 are examples of handheld or mobile devices.

FIG. 7 provides a general block diagram of the components of a client device 16 that can run some components shown in FIG. 2, that interacts with them, or both. In the device 16, a communications link 13 is provided that allows the handheld device to communicate with other computing devices and under some examples provides a channel for receiving information automatically, such as by scanning. Examples of communications link 13 include allowing communication though one or more communication protocols, such as wireless services used to provide cellular access to a network, as well as protocols that provide local wireless connections to networks.

Under other examples, applications can be received on a removable Secure Digital (SD) card that is connected to an interface 15. Interface 15 and communication links 13 communicate with a processor 17 (which can also embody processor 130 from FIG. 2) along a bus 19 that is also connected to memory 21 and input/output (I/O) components 23, as well as clock 25 and location system 27.

I/O components 23, in one example, are provided to facilitate input and output operations. I/O components 23 for various examples of the device 16 can include input components such as buttons, touch sensors, optical sensors, microphones, touch screens, proximity sensors, accelerometers, orientation sensors and output components such as a display device, a speaker, and or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 21 stores operating system 29, network and applications 33, application configuration settings 35, contact or phonebook application 43, data store 37, communication drivers 39, and communication configuration settings 41. Memory 21 can include all types of tangible volatile and non-volatile computer-readable memory devices. It can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

FIG. 8 shows one example in which device 16 is a tablet computer 600. In FIG. 8, computer 600 is shown with user interface display screen 602. Screen 602 can be a touch screen or a pen-enabled interface that receives inputs from a pen or stylus. It can also use an on-screen virtual keyboard. Of course, it might also be attached to a keyboard or other user input device through a suitable attachment mechanism, such as a wireless link or USB port, for instance. Computer 600 can also illustratively receive voice inputs as well.

FIG. 9 provides an additional example of devices 16 that can be used, although others can be used as well. The phone in FIG. 9 is a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

Figure 10:
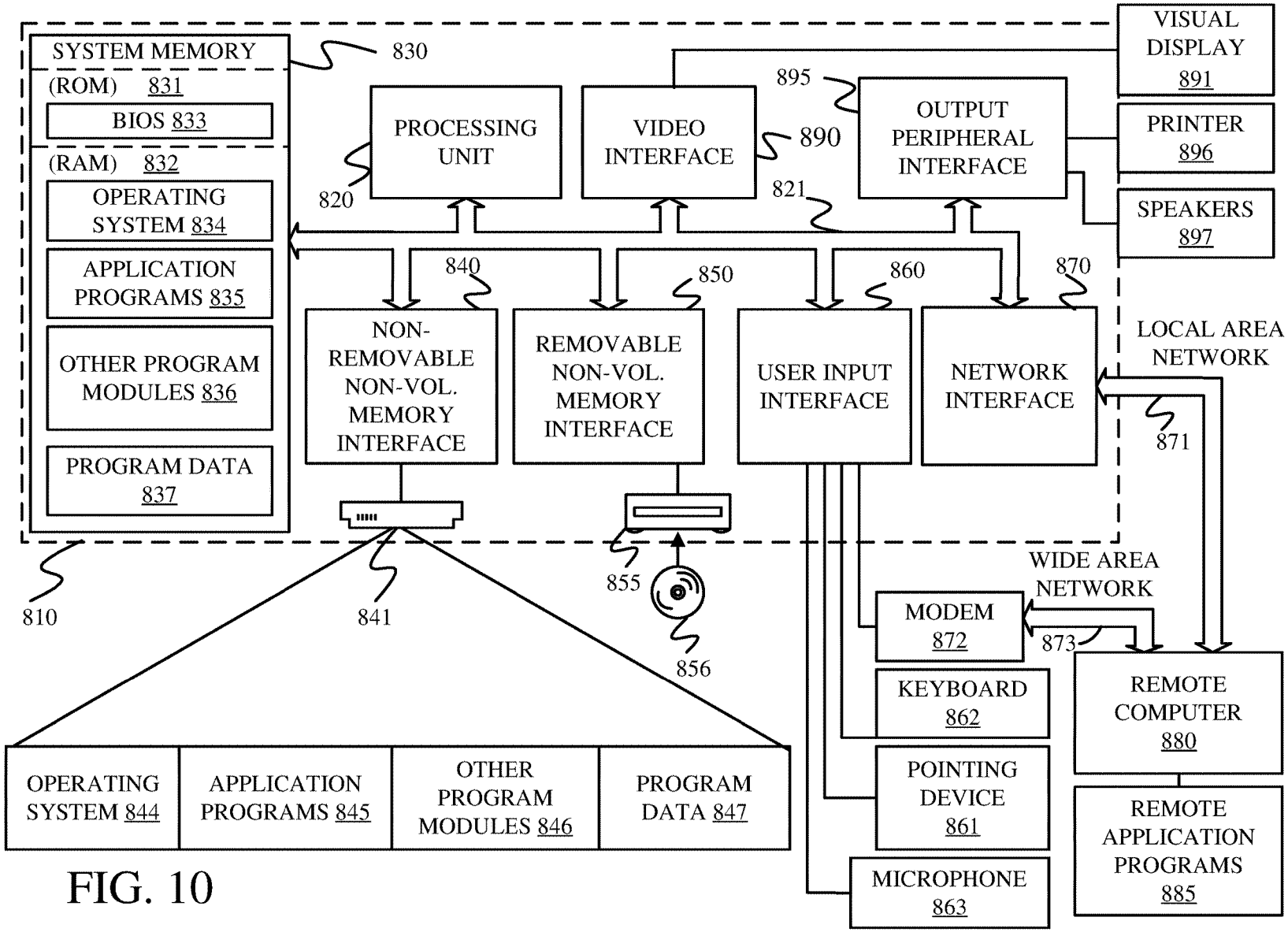
FIG. 10 is a block diagram showing one example of a computing environment that can be used in the work machine and/or in the architectures shown in the previous figures.

FIG. 10 is one example of a computing environment in which elements of FIG. 2, or parts of it, (for example) can be deployed. With reference to FIG. 10, an example system for implementing some examples includes a general-purpose computing device in the form of a computer 810. Components of computer 810 may include, but are not limited to, a processing unit 820 (which can comprise processor 228), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 2 can be deployed in corresponding portions of FIG. 10.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 10 illustrates operating system 834, application programs 835, other program modules 836, and program data 837.

The computer 810 may also include other removable/non-removable volatile/nonvolatile computer storage media. By way of example only, FIG. 10 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840 and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 10, provide storage of computer readable instructions, data structures, program modules and other data for the computer 810. In FIG. 10, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 9 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Example 1 is a mobile work machine, comprising:

a frame;

a set of ground engaging elements movably supported by the frame and driven by an engine to drive movement of the mobile work machine;

a movable element movably supported by the frame to move relative to the frame;

an actuator coupled to the movable element to controllably drive movement of the movable element;

a control system that generates an actuator control signal, indicative of a commanded movement of the actuator, and provides the actuator control signal to the actuator to control the actuator to perform the commanded movement; and a self-protection system, coupled to the control system, that determines whether the commanded movement will result in contact between the movable element and a protected portion of the mobile work machine and, if so, generates a limit signal, limiting the commanded movement to avoid the contact.

Example 2 is the mobile work machine of any or all previous examples and further comprising:

a sensor that senses a position of the movable element and generates a position signal indicative of the sensed position.

Example 3 is the mobile work machine of any or all previous examples wherein the self-protection system comprises:

data store interaction logic configured to interact with a data store to obtain machine dimension data indicative of dimensions of the mobile work machine and movable element dimension data indicative of dimensions of the movable element.

Example 4 is the mobile work machine of any or all previous examples wherein the self-protection system comprises:

machine geometry logic configured to receive the machine dimension data and the movable element dimension data and to identify a relative position of the movable element relative to the protected portion of the mobile work machine.

Example 5 is the mobile work machine of any or all previous examples wherein the self-protection system comprises:

collision logic configured to receive the identified relative position and the commanded movement and determine whether the commanded movement will result in the contact based on the relative position.

Example 6 is the mobile work machine of any or all previous examples wherein the collision logic is configured to determine whether the commanded movement will result in the contact by identifying a movable element boundary, indicative of a boundary of the movable element, based on the movable element dimensional information and a protected portion boundary, indicative of a boundary of the protected portion of the mobile work machine, based on the machine dimension data.

Example 7 is the mobile work machine of any or all previous examples wherein the collision logic is configured to determine whether the commanded movement will result in the contact by determining whether the commanded movement will result in an intersection of a portion of the movable element boundary with a portion of the protected portion boundary.

Example 8 is the mobile work machine of any or all previous examples wherein the movable element comprises an attachment, and further comprising:

calibration logic configured to receive the movable element dimension data and an attachment identifier identifying the attachment corresponding to the movable element dimension data, and to store the movable element dimension data and corresponding attachment identifier in the data store.

Example 9 is the mobile work machine of any or all previous examples wherein the calibration logic comprises:

input logic configured to detect an operator input indicative of the attachment identifier and the movable element dimension data.

Example 10 is the mobile work machine of any or all previous examples wherein the calibration logic comprises:

sensor logic configured to receive a sensor signal indicative of the movable element dimension data and the attachment identifier.

Example 11 is a method of controlling a mobile work machine, comprising:

receiving an operator input indicative of a commanded movement of an actuator that drives movement of a movable element coupled to a frame of the mobile work machine;

determining whether the commanded movement will result in contact between the movable element and a protected portion of the mobile work machine;

if so, generating a limit signal, limiting the commanded movement to avoid the contact;

providing the limit signal to the actuator to control the actuator to drive limited movement of the movable element to avoid the contact.

Example 12 is the method of any or all previous examples further comprising:

sensing a position of the movable element; and generating a position signal indicative of the sensed position.

Example 13 is the method of any or all previous examples wherein determining whether the commanded movement will result in contact between the movable element and a protected portion of the mobile work machine comprises:

interacting with a data store to obtain machine dimension data indicative of dimensions of the mobile work machine and movable element dimension data indicative of dimensions of the movable element; and identifying a relative position of the movable element relative to the protected portion of the mobile work machine based on the position signal, the machine dimension data and the movable element dimension data.

Example 14 is the method of any or all previous examples wherein determining whether the commanded movement will result in contact between the movable element and a protected portion of the mobile work machine comprises:

determining whether the commanded movement will result in the contact based on the relative position.

Example 15 is the method of any or all previous examples wherein determining whether the commanded movement will result in contact between the movable element and a protected portion of the mobile work machine comprises:

identifying a movable element boundary, indicative of a boundary of the movable element, based on the movable element dimensional information;

identifying a protected portion boundary, indicative of a boundary of the protected portion of the mobile work machine, based on the machine dimension data; and determining whether the commanded movement will result in an intersection of a portion of the movable element boundary with a portion of the protected portion boundary.

Example 16 is the method of any or all previous examples wherein the movable element comprises an attachment, and further comprising:

receiving an attachment identifier identifying the attachment corresponding to the movable element dimension data; and storing the movable element dimension data and corresponding attachment identifier in the data store.

Example 17 is the method of any or all previous examples and further comprising:

detecting an operator input indicative of the attachment identifier identifying the attachment; and detecting an operator input indicative of the movable element dimension data indicative of a dimension of the movable element.

Example 18 is the method of any or all previous examples and further comprising:

detecting a sensor signal indicative of the movable element dimension data and the attachment identifier.

Example 19 is a control system on a mobile work machine, comprising:

control logic that generates an actuator control signal, indicative of a commanded movement of an actuator coupled to a movable element to controllably drive movement of the movable element, and provides the actuator control signal to the actuator to control the actuator to perform the commanded movement;

collision logic that determines whether the commanded movement will result in contact between the movable element and a protected portion of the mobile work machine; and limit logic that if the commanded movement will result in contact between the movable element and a protected portion of the mobile work machine, generates a limit signal, limiting the commanded movement to avoid the contact.

Example 20 is the control system of any or all previous examples and further comprising:

a sensor that senses a position of the movable element and generates a position signal indicative of the sensed position;

data store interaction logic configured to interact with a data store to obtain machine dimension data indicative of dimensions of the mobile work machine and movable element dimension data indicative of dimensions of the movable element;

machine geometry logic configured to receive the machine dimension data and the movable element dimension data and to identify a relative position of the movable element relative to the protected portion of the mobile work machine, wherein the collision logic is configured to receive the identified relative position and the commanded movement and determine whether the commanded movement will result in the contact based on the relative position and to determine whether the commanded movement will result in the contact by identifying a movable element boundary, indicative of a boundary of the movable element, based on the movable element dimensional information and a protected portion boundary, indicative of a boundary of the protected portion of the mobile work machine, based on the machine dimension data.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A mobile work machine, comprising:

a frame;

a set of ground engaging elements movably supported by the frame and driven by an engine to drive movement of the mobile work machine;

a movable element movably supported by the frame to move relative to the frame, the movable element comprising an attachment;

calibration logic configured to obtain movable element dimension data and an attachment identifier identifying the attachment corresponding to the movable element dimension data, and to store the movable element dimension data and corresponding attachment identifier in a data store;

an actuator coupled to the movable element to controllably drive movement of the movable element;

a control system that generates an actuator control signal, indicative of a commanded movement of the actuator, and provides the actuator control signal to the actuator to control the actuator to perform the commanded movement; and a self-protection system, coupled to the control system, including:

data store interaction logic configured to interact with the data store to obtain machine dimension data indicative of dimensions of the mobile work machine and the movable element dimension data indicative of dimensions of the movable element;

machine geometry logic that identifies a relative position of the movable element relative to a protected portion of the mobile work machine; and collision logic that receives the identified relative position and the commanded movement, determines whether the commanded movement will result in contact between the movable element and the protected portion of the mobile work machine based on the relative position, and generates a limit signal, limiting the commanded movement to avoid the contact when the commanded movement will result in contact between the movable element and the protected portion of the mobile work machine.

2. The mobile work machine of claim 1 and further comprising:

a sensor that senses a position of the movable element and generates a position signal indicative of the sensed position.

3. The mobile work machine of claim 1 wherein the machine geometry logic is configured to receive the machine dimension data and the movable element dimension data and to identify the relative position of the movable element relative to the protected portion of the mobile work machine based on the machine dimension data and the movable element dimension data.

4. The mobile work machine of claim 3 wherein the collision logic is configured to determine whether the commanded movement will result in the contact by identifying a movable element boundary, indicative of a boundary of the movable element, based on the movable element dimensional information and a protected portion boundary, indicative of a boundary of the protected portion of the mobile work machine, based on the machine dimension data.

5. The mobile work machine of claim 4 wherein the collision logic is configured to determine whether the commanded movement will result in the contact by determining whether the commanded movement will result in an intersection of a portion of the movable element boundary with a portion of the protected portion boundary.

6. The mobile work machine of claim 1 wherein the calibration logic comprises:

input logic configured to detect an operator input indicative of the attachment identifier and the movable element dimension data.

7. The mobile work machine of claim 1 wherein the calibration logic comprises:

sensor logic configured to receive a sensor signal indicative of the movable element dimension data and the attachment identifier.

8. A method of controlling a mobile work machine, comprising:

obtaining and storing attachment dimension data, indicative of dimensions of an attachment, and a corresponding attachment identifier identifying the attachment, in a data store;

receiving an operator input indicative of a commanded movement of an actuator that drives movement of the attachment coupled to a frame of the mobile work machine;

interacting with the data store to obtain machine dimension data indicative of dimensions of the mobile work machine and the attachment dimension data indicative of dimensions of the attachment;

identifying a relative position of the movable element relative to a protected portion of the mobile work machine based on the machine dimension data and the attachment dimension data;

determining whether the commanded movement will result in contact between the attachment and the protected portion of the mobile work machine based on the relative position;

generating a limit signal, limiting the commanded movement to avoid the contact when the commanded movement will result in contact between the attachment and the protected portion of the mobile work machine; and providing the limit signal to the actuator to control the actuator to drive limited movement of the attachment to avoid the contact.

9. The method of claim 8 further comprising:

sensing a position of the attachment; and generating a position signal indicative of the sensed position.

10. The method of claim 9 wherein identifying the relative position of the attachment relative to the protected portion of the mobile work machine based on the machine dimension data and the attachment dimension data comprises:

identifying a relative position of the attachment relative to the protected portion of the mobile work machine based on the position signal, the machine dimension data and the attachment dimension data.

11. The method of claim 8 wherein determining whether the commanded movement will result in contact between the attachment and a protected portion of the mobile work machine based on the relative position comprises:

identifying a movable element boundary, indicative of a boundary of the attachment, based on the attachment dimension data;

identifying a protected portion boundary, indicative of a boundary of the protected portion of the mobile work machine, based on the machine dimension data; and determining whether the commanded movement will result in an intersection of a portion of the movable element boundary with a portion of the protected portion boundary.

12. The method of claim 8 and further comprising:

detecting an operator input indicative of the attachment identifier identifying the attachment; and detecting an operator input indicative of the attachment dimension data indicative of a dimension of the attachment.

13. The method of claim 8 further comprising:

detecting a sensor signal indicative of the movable element dimension data and the attachment identifier.

14. A control system on a mobile work machine, comprising:

control logic that generates an actuator control signal, indicative of a commanded movement of an actuator coupled to a movable element to controllably drive movement of the movable element, and provides the actuator control signal to the actuator to control the actuator to perform the commanded movement;

data store interaction logic configured to interact with a data store to obtain machine dimension data indicative of dimensions of the mobile work machine and movable element dimension data indicative of dimensions of the movable element;

collision logic configured to receive the commanded movement and determine whether the commanded movement will result in contact between the movable element and a protected portion of the mobile work machine by identifying a movable element boundary, indicative of a boundary of the movable element, based on the movable element dimension data and a protected portion boundary indicative of a boundary of the protected portion of the mobile work machine, based on the machine dimension data; and limit logic that generates a limit signal, limiting the commanded movement to avoid the contact when the commanded movement will result in contact between the movable element and the protected portion of the mobile work machine.

15. A mobile work machine, comprising:

a frame;

a set of ground engaging elements movably supported by the frame and driven by an engine to drive movement of the mobile work machine;

a movable element movably supported by the frame to move relative to the frame;

an actuator coupled to the movable element to controllably drive movement of the movable element;

a sensor that senses a position of the movable element and generates a position signal indicative of the sensed position;

a control system that generates an actuator control signal, indicative of a commanded movement of the actuator, and provides the actuator control signal to the actuator to control the actuator to perform the commanded movement; and a self-protection system, coupled to the control system, including:

data store interaction logic configured to interact with a data store to obtain machine dimension data indicative of dimensions of the mobile work machine and movable element dimension data indicative of dimensions of the movable element;

machine geometry logic that receives the machine dimension data and the movable element dimension data and identifies a relative position of the movable element relative to a protected portion of the mobile work machine based on the machine dimension data and the movable element dimension data; and collision logic configured to;

receive the identified relative position and the commanded movement, determine whether the commanded movement will result in contact between the movable element and the protected portion of the mobile work machine by identifying a movable element boundary, indicative of a boundary of the movable element, based on the movable element dimensional information and a protected portion boundary, indicative of a boundary of the protected portion of the mobile work machine, based on the machine dimension data, and generate a limit signal, limiting the commanded movement to avoid the contact when the commanded movement will result in contact between the movable element and the protected portion of the mobile work machine.

16. A method of controlling a mobile work machine, comprising:

receiving an operator input indicative of a commanded movement of an actuator that drives movement of a movable element coupled to a frame of the mobile work machine;

interacting with a data store to obtain machine dimension data indicative of dimensions of the mobile work machine and movable element dimension data indicative of dimensions of the movable element;

identifying a relative position of the movable element relative to a protected portion of the mobile work machine based on the machine dimension data and the movable element dimension data;

identifying a movable element boundary, indicative of a boundary of the movable element, based on the movable element dimension data;

identifying a protected portion boundary, indicative of a boundary of a protected portion of the mobile work machine, based on the machine dimension data; and determining whether the commanded movement will result in an intersection of a portion of the movable element boundary with a portion of the protected portion boundary;

generating a limit signal, limiting the commanded movement to avoid the intersection when the commanded movement will result in contact between the movable element and the protected portion of the mobile work machine; and providing the limit signal to the actuator to control the actuator to drive limited movement of the movable element to avoid the contact.

17. A control system on a mobile work machine, comprising:

control logic that generates an actuator control signal, indicative of a commanded movement of an actuator coupled to a movable element to controllably drive movement of the movable element, and provides the actuator control signal to the actuator to control the actuator to perform the commanded movement;

a sensor that senses a position of the movable element and generates a position signal indicative of the sensed position;

data store interaction logic configured to interact with a data store to obtain machine dimension data indicative of dimensions of the mobile work machine and movable element dimension data indicative of dimensions of the movable element;

machine geometry logic configured to receive the machine dimension data and the movable element dimension data and to identify a relative position of the movable element relative to a protected portion of the mobile work machine;

collision logic that receives the identified relative position and the commanded movement and determines whether the commanded movement will result in contact between the movable element and the protected portion of the mobile work machine based on the relative position and by identifying a movable element boundary, indicative of a boundary of the movable element, based on the movable element dimension data and a protected portion boundary, indicative of a boundary of the protected portion of the mobile work machine, based on the machine dimension data; and limit logic that generates a limit signal, limiting the commanded movement to avoid the contact when the commanded movement will result in contact between the movable element and the protected portion of the mobile work machine.

* * * * *